US010087657B2

(12) United States Patent
Uemura et al.

(10) Patent No.: US 10,087,657 B2
(45) Date of Patent: Oct. 2, 2018

(54) HANDLE DEVICE FOR VEHICLE

(71) Applicant: Alpha Corporation, Yokohama-shi, Kanagawa (JP)

(72) Inventors: Isamu Uemura, Yokohama (JP); Noriaki Ito, Yokohama (JP); Makoto Igeta, Yokohama (JP)

(73) Assignee: ALPHA CORPORATION, Kanagawa (JP)

( * ) Notice: Subject to any disclaimer, the term of this patent is extended or adjusted under 35 U.S.C. 154(b) by 342 days.

(21) Appl. No.: 14/784,093

(22) PCT Filed: May 13, 2014

(86) PCT No.: PCT/JP2014/062691

§ 371 (c)(1),
(2) Date: Oct. 13, 2015

(87) PCT Pub. No.: WO2014/188909

PCT Pub. Date: Nov. 27, 2014

(65) Prior Publication Data

US 2016/0076275 A1 Mar. 17, 2016

(30) Foreign Application Priority Data

May 24, 2013 (JP) ..... 2013-109690

(51) Int. Cl.
*E05B 53/00* (2006.01)
*E05B 79/20* (2014.01)
*E05B 79/06* (2014.01)

(52) U.S. Cl.
CPC ..... *E05B 53/005* (2013.01); *E05B 79/06* (2013.01); *E05B 79/20* (2013.01); *E05B 85/13* (2013.01)

(58) Field of Classification Search
CPC ..... E05B 53/003; E05B 53/005; E05B 79/20; E05B 79/06; E05B 79/22; E05B 85/12;
(Continued)

(56) References Cited

U.S. PATENT DOCUMENTS 5,350,206 A 9/1994 Akahori et al.
6,067,874 A * 5/2000 Meissner ..... F16C 1/26 403/326

(Continued)

FOREIGN PATENT DOCUMENTS

| | | | | |
|---|---|---|---|---|
| CN | 1756017 | A | 4/2006 | |
| CN | 101936090 | A | 1/2011 | |
| DE | 19837662 | A1 * | 4/1999 | ..... B60J 5/0413 |
| DE | 102008027343 | A1 * | 12/2009 | ..... F02D 35/023 |
| FR | 2876077 | A1 * | 4/2006 | ..... E05B 79/06 |
| JP | 04-297684 | A | 10/1992 | |
| JP | 09-96131 | A | 4/1997 | |
| JP | 2012-97476 | A | 5/2012 | |
| KR | 20070025706 | A * | 3/2007 | |
| KR | 10-2011-0096719 | A | 8/2011 | |

OTHER PUBLICATIONS

Official Communication issued in International Patent Application No. PCT/JP2014/062691, dated Jul. 29, 2014.

*Primary Examiner* — Christine M Mills
(74) *Attorney, Agent, or Firm* — Keating and Bennett, LLP

(57) ABSTRACT

A handle device for a vehicle is provided with: an operating section rotatably connected to a handle base; a cable device formed by inserting in a slidable manner an inner cable, which has a connection section provided at the front end thereof, into an outer cable, the cable device being configured in such a manner that the connection section of the inner cable is fitted to a cable connection hole, which is formed in the operating section, to enable operating force applied to the operating section to be transmitted to a door lock device on the vehicle side; and a connection aid connected to the front end of the outer cable and mounted on the handle base while holding the connection section of the inner cable in a movable manner.

6 Claims, 4 Drawing Sheets

(58) Field of Classification Search
CPC ..... E05B 85/13; Y10S 292/53; Y10S 292/63; Y10S 292/64; Y10T 74/2045; Y10T 74/20462; Y10T 292/1017; Y10T 292/57; Y10T 292/03; Y10T 292/083; Y10T 292/0841; Y10T 292/0855; Y10T 292/0931; Y10T 292/094; Y10T 292/0992; Y10T 292/1057; Y10T 292/1069
USPC ..... 292/141, 336.3, 1, 28, 38, 50, 125, 133, 292/171, 225, 235, DIG. 53, DIG. 63, 292/DIG. 64
See application file for complete search history.

(56) References Cited

U.S. PATENT DOCUMENTS 6,158,788 A * 12/2000 Ikeda ..... E05B 81/06 292/216
2011/0308172 A1* 12/2011 Schidan ..... B60J 5/0416 49/503
2013/0038074 A1* 2/2013 Mori ..... E05B 79/20 292/336.3
2014/0076094 A1* 3/2014 Mori ..... E05B 79/20 74/502.2

* cited by examiner (a)

(b)

HANDLE DEVICE FOR VEHICLE

TECHNICAL FIELD

The present invention relates to a handle device for a vehicle.

BACKGROUND ART

A device described in Patent Document 1 has been known as a handle device for a vehicle configured to be mounted on a door of the vehicle.

In this conventional example, the handle device is formed by rotatably connecting a lock knob and an inner door handle (operating sections) on a handle base. The front end of an inner cable of a cable device is locked to an engagement portion formed in each operating section. Rotational operating force on the operating section is transmitted to a latch lock unit through the inner cable.

PRIOR ART DOCUMENT

Patent Document

Patent Document 1: Japanese Patent Application Publication No. 2012-97476

SUMMARY OF THE INVENTION

Problem to be Solved by the Invention

Here, in the above conventional example, the inner cable needs to be engaged with the engagement portion in such a state that the inner cable can be prevented from falling when the operating section is operated. This leads to a problem in that the ease of the engagement is lowered and the ease of the assembly is therefore lowered.

The present invention has been made to solve the above drawback, and an object thereof is to provide a handle device configured so as to enable easier connection of a cable device.

Means for Solving the Problem

According to the present invention, the above object is achieved by providing a handle device for a vehicle, including:

an operating section 2 rotatably connected to a handle base 1;

a cable device 8 formed by slidably inserting, in an outer cable 5, an inner cable 4 including a connection section 3 at a front end thereof, and configured such that the connection section 3 of the inner cable 4 is fitted in a cable connection hole 6 bored in the operating section 2, to thereby transmit operating force applied to the operating section 2 to a door lock device 7 on a vehicle side; and a connection aid 9 connected to a front end of the outer cable 5 and mounted on the handle base 1 while movably holding the connection section 3 of the inner cable 4, in which the inner cable 4 is configured such that, when the connection aid 9 is mounted, the connection section 3 is fitted from a free end thereof into the cable connection hole 6, and movement of the inner cable 4 in a direction of fitting and removal thereof is restricted by a restriction wall 10 formed on the connection aid 9.

The handle device for a vehicle is formed by rotatably connecting the operating section 2 to the handle base 1, and the cable device 8 is connected to the operating section 2 by connecting the connection aid 9, which is mounted on the front end of the cable device 8 in advance, to the handle base 1.

In the present invention, the connection section 3 of the inner cable 4 of the cable device 8 can be fitted into the cable connection hole 6 of the operating section 2 by connecting the connection aid 9, which is connected to the outer cable 5 in advance, to the handle base 1. In this way, the connection is significantly easier than the operation in which the connection section 3, which is fixed at the front end of the inner cable 4 made in the form of soft wire, is connected directly to the cable connection hole 6 of the operating section 2 in such a manner as not to fall from the cable connection hole 6. In addition, since the connection aid 9 is provided with the restriction wall 10, the connection section 3 can be reliably prevented from falling from the cable connection hole 6.

Also, since the inner cable 4 is connected by fitting the connection section 3 from its free end into the cable connection hole 6, the cable connection hole 6 can be formed as a circular hole or the like with a closed periphery. Hence, the clanking can be reduced and the stroke loss due to the clanking can be reduced as compared to a case where the connection section 3 is fitted into the cable connection hole 6 through a cut-out portion formed in the periphery of the cable connection hole 6.

Further, if the operating section 2 is operated in a state where no tensile force is exerted on the inner cable 4 due to failure in the operation of the door lock device 7 or the like, a compressive force may sometimes be generated on the inner cable 4 and bend the inner cable 4 in a buckling direction. In this situation, in the case of the configuration in which the connection section 3 is inserted into the cable connection hole 6 through the cut-out portion, the connection section 3 may possibly be removed from the cable connection hole 6 when the inner cable 4 coincides with the cut-out portion. However, in the case where the cable connection hole 6 is formed as the closed circular hole or the like, it is possible to completely prevent the removal of the cable due to the bend of the inner cable 4 or the like. Hence, the operation reliability is improved.

Also, the handle device may be configured such that an end of the connection section 3 of the inner cable 4 opposite the end thereof fitted in the cable connection hole 6 is guided by a guide hole 11 formed in the restriction wall 10, in such a manner as to be capable of moving within and not to fall from the guide hole 11.

The inner cable 4, once connected to the cable connection hole 6, moves in such a manner as to follow the trajectory of movement of the cable connection hole 6. In this way, an exclusive guide member is not additionally needed. By connecting the connection section 3 to the guide hole 11 as mentioned above, it is possible to stabilize the posture of the inner cable 4 until it is fitted into the cable connection hole 6.

Various methods are available for mounting the connection aid 9 onto the handle base 1 such as locking one side edge of the connection aid 9 onto the handle base 1 and then turning the connection aid 9 about the locked position.

However, the connection aid 9 may be configured to be connected to the handle base 1 by being slid along the handle base 1 and snap-locked onto the handle base 1. In this way, the connection aid 9 can be mounted by simply moving the connection aid 9 along the handle base 1. Hence, the mounting efficiency can be improved.

Also, in a case where a plurality of the operation sections 2 are connected to the handle base 1, and a plurality of the cable devices 8 are connected respectively to the respective operation sections 2, a plurality of the connection aids 9 may be mounted respectively on the cable devices 8. However, by employing a configuration in which the plurality of cable devices 8 are connected a single connection aid 9, the mounting workability can be improved.

In this case, the handle device may be configured such that a plurality of the operation sections 2 are connected to the handle base 1, a plurality of the cable devices 8 connected respectively to the operation sections 2 are connected to the single connection aid 9, and the inner cable 4 of each of the cable devices 8 is connected to the cable connection hole 6 of the corresponding operating section 2 when the connection aid 9 is mounted onto the handle base 1.

Further, the handle device may be configured such that the connection aid 9 is formed in a cover shape to close an insertion opening 12 which is bored in the handle base 1 for the operating section 2, and to isolate a surface region of the handle base 1 from a door inner space in cooperation with the handle base 1.

In general, the cable device 8 connected to the operating section 2 is routed inside the door body. For this reason, the insertion opening 12 is bored in the handle base 1 for introducing the operating section 2 to the inside of the door body. On the other hand, in a case where the handle device is formed as an inside handle, the insertion opening 12 is a communication opening between the space inside the door body and a space defined by the surface of the handle base 1, i.e. the interior space. For this reason, the communication opening may possibly be an opening through which wind and the like enter from the door inner space into the interior. However, according to the present invention, the connection aid 9 closes the communication opening and can therefore completely prevent entrance of wind and the like into the interior.

Effect of the Invention

According to the present invention, the connection of the cable device to the operating section is completed simply by connecting the connection aid, which is mounted on the cable device in advance, to the handle base. Hence, the assembly workability can be improved.

MODE FOR CARRYING OUT THE INVENTION

Figure 1:
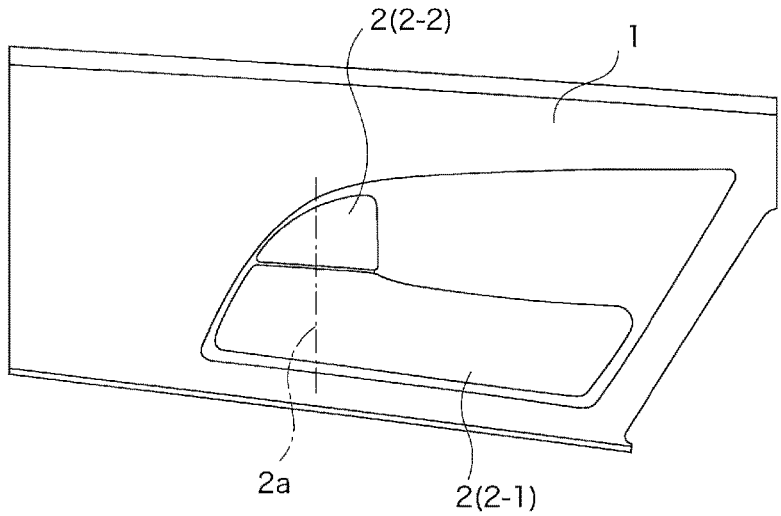
FIG. 1 is a set of views showing the present invention, and part (a) is a front view and part (b) is a back view.
Figure 1:
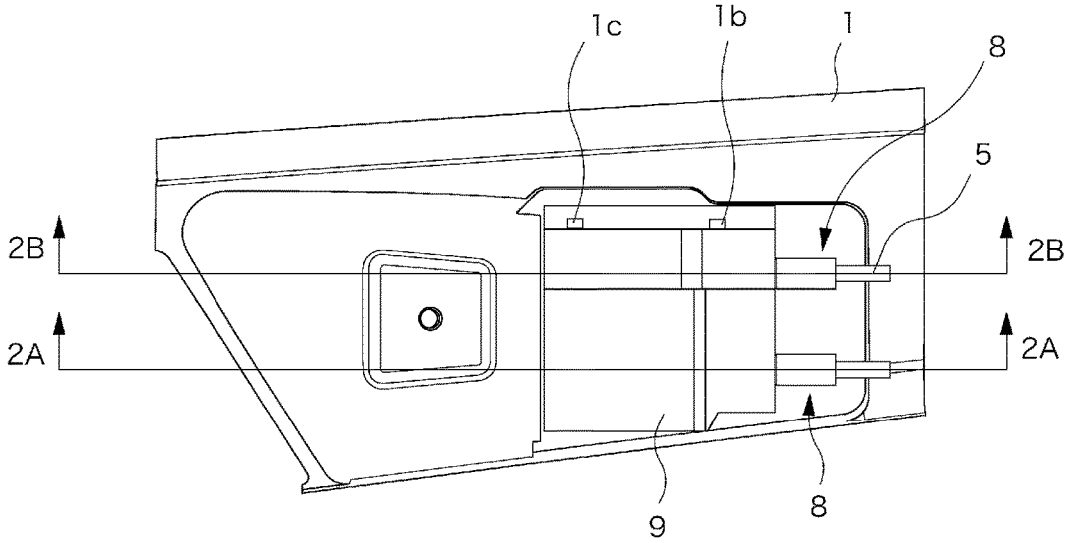

FIG. 1 and the subsequent figures show an embodiment of the present invention which is made as an inside handle device for a vehicle.

The inside handle device is formed by connecting two operating sections 2 (an operation handle 2-1 and a lock knob 2-2) to a handle base 1 rotatably about a rotational axis 2*a*, and is used with the handle base 1 fixed to an inner panel of a door of the vehicle.

Figure 2:
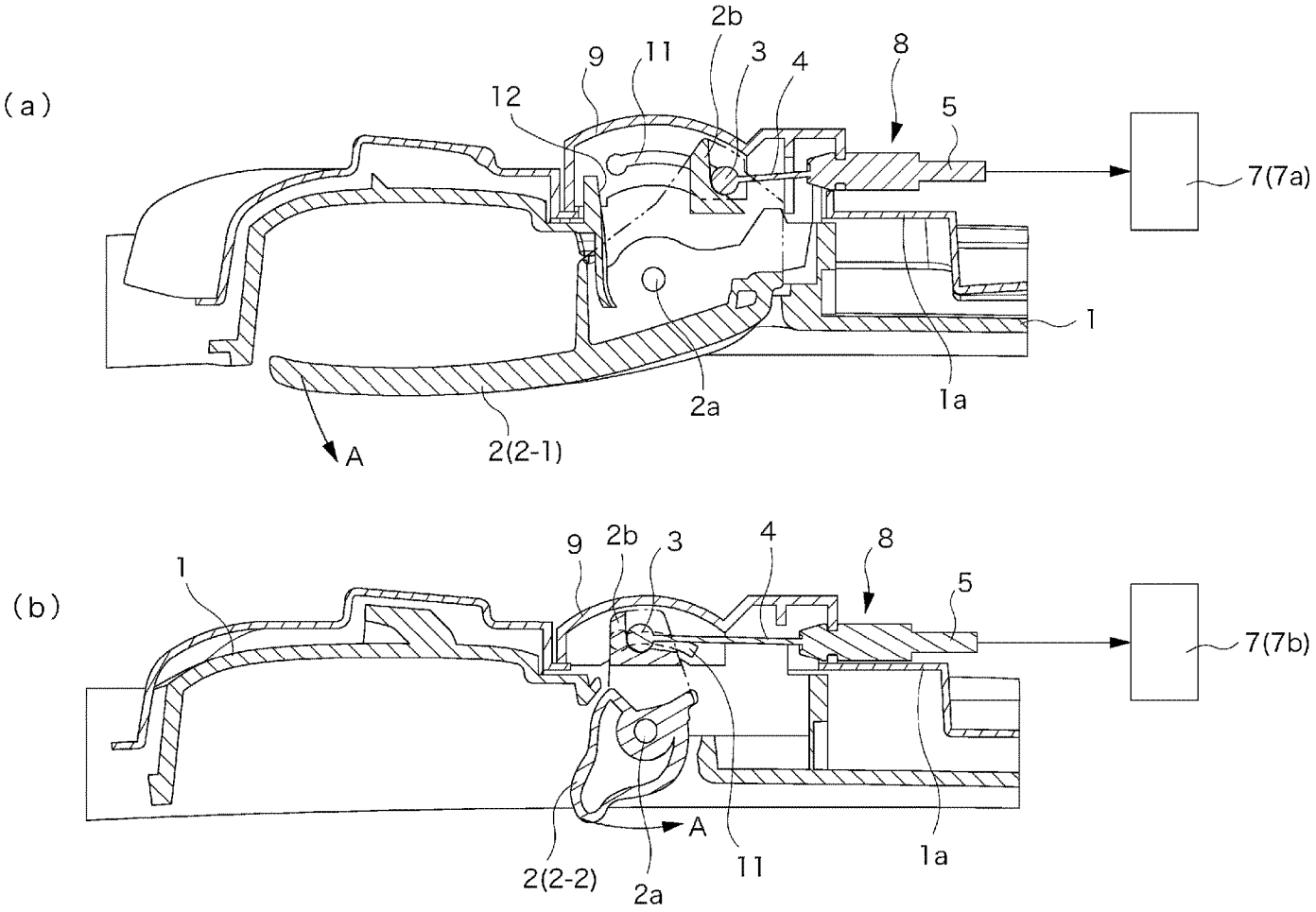
FIG. 2 is a set of cross-sectional views of FIG. 1, and part (a) is a cross-sectional view taken along line 2A-2A in part (b) of FIG. 1 and part (b) is a cross-sectional view taken along line 2B-2B in part (b) of FIG. 1.

As shown in FIG. 2, cable devices 8 are connected to the operating sections 2, respectively, each cable device 8 being formed by inserting an inner cable 4 slidably in an outer cable 5. As shown in part (a) of FIG. 2, the cable device 8 that is connected to the operation handle 2-1 is connected to a latch control section 7*a* of a door lock device 7. When the operation handle 2-1 is turned in the direction of arrow A from an initial rotational position shown in part (a) of FIG. 2, the operating force is transmitted to the latch control section 7*a* of the door lock device 7 through the inner cable 4, thereby disengaging a latch which is maintaining the door closed.

On the other hand, the lock knob 2-2 is connected to a lock control section 7*b* of the above door lock device 7. When the lock knob 2-2 is turned in the direction of arrow A from an initial rotational position in part (b) of FIG. 2 to a lock position, the lock control section 7*b* shifts to a lock state. Once the lock control section 7*b* shifts to the lock state, operation of the latch control section 7*a* through the operation handle 2-1 is inhibited.

A connection aid 9 is connected to the cable devices 8 in order to enable easier mounting of the cable devices 8 to the operating sections 2.

Figure 3:
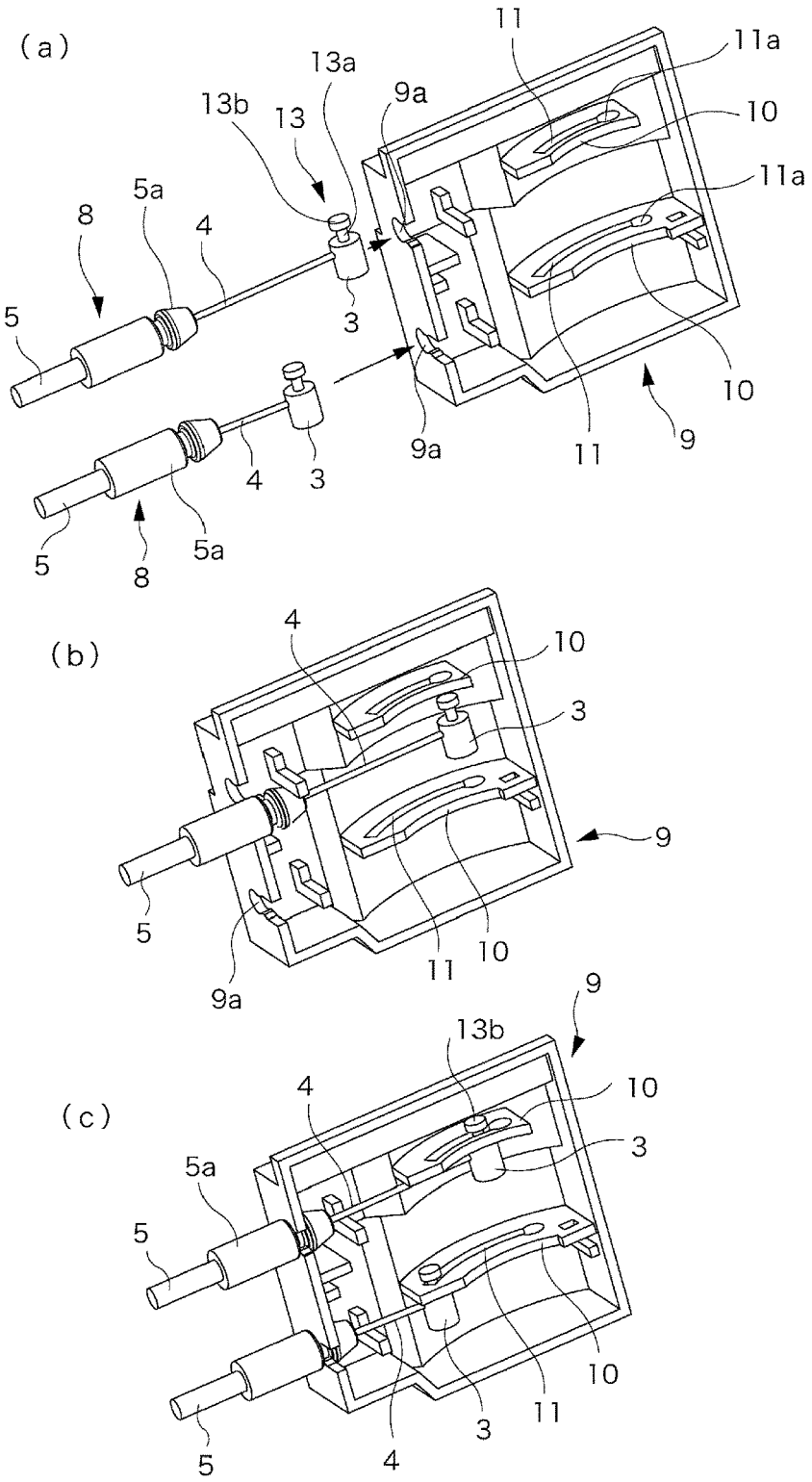
FIG. 3 is a set of perspective views showing a connection aid, and part (a) is a view showing a state before cable devices are connected, part (b) is a view showing a state where a connection section of an inner cable is about to be connected to a guide hole, and part (c) is a view showing a state where the cable devices are connected.
Figure 4:
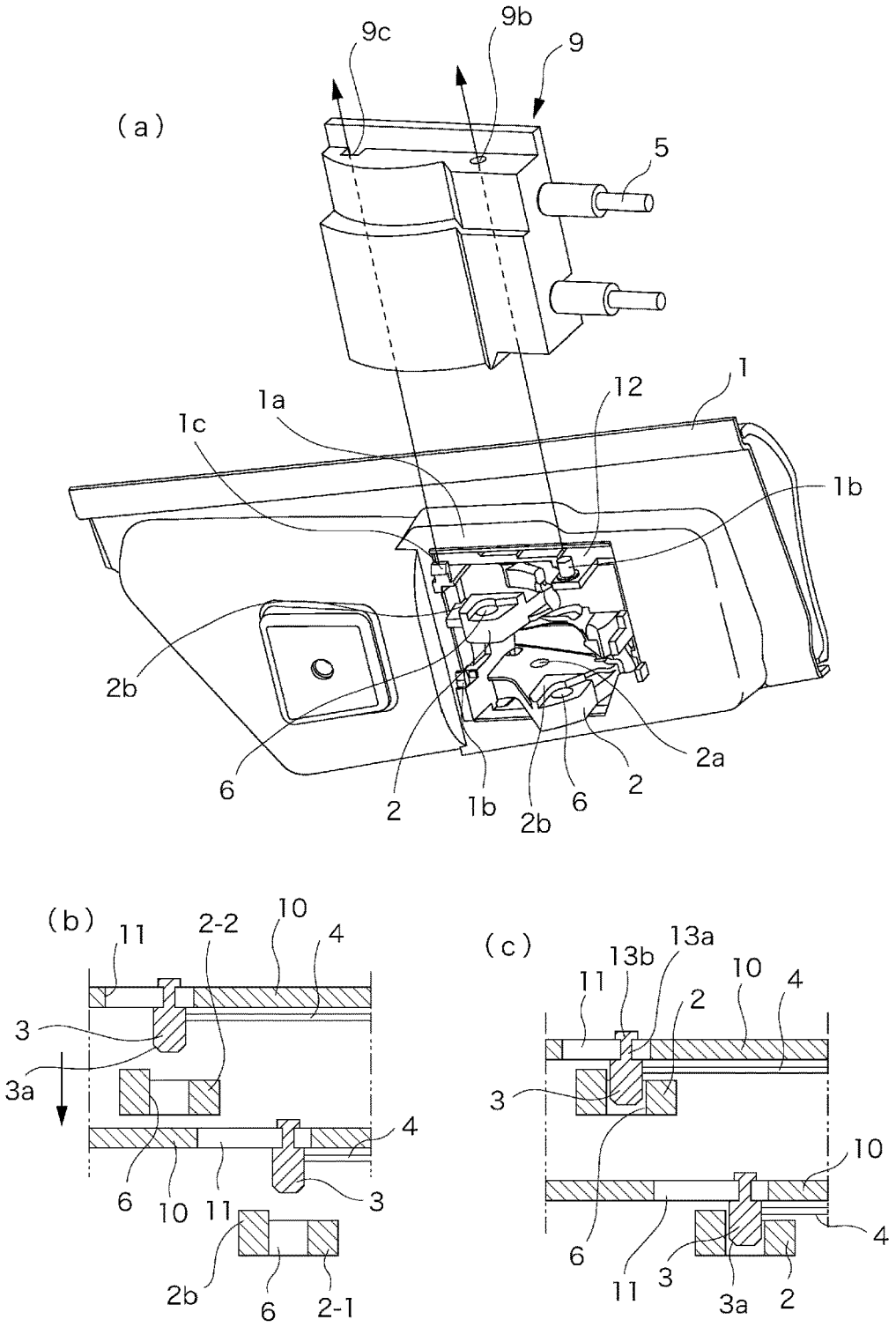
FIG. 4 is a set of views showing states across which the connection aid is connected to a handle base, and part (a) is a perspective view, part (b) is an explanatory view showing the positional relationship between each connection section and its corresponding cable connection hole at the beginning of connecting operation, and part (c) is an explanatory view showing a state after fitting is completed.

As shown in FIGS. 3 and 4, the connection aid 9 is formed in a box shape capable of closing an insertion opening 12 that is bored in a bottom wall section of the handle base 1 and communicates with the inside of the door body. Two fitting fixing recesses 9*a* are provided in a side wall of the connection aid 9.

On the other hand, as shown in part (a) of FIG. 3, each outer cable 5 has an attachment fitting 5*a* fixed at the front end thereof. Each cable device 8 is connected to the connection aid 9 by snap-fitting the attachment fitting 5*a* on its outer cable 5 into the corresponding fitting fixing recess 9*a*.

Moreover, the inner cable 4 of each cable device 8 has a connection fitting 13 fixed at the front end thereof, and a connection section 3 is formed protruding laterally with respect to the longitudinal direction of the inner cable 4. Specifically, the connection fitting 13 includes: the connection section 3 which has a cylindrical shape with its center axis aligned with a direction perpendicular to the cable length direction of the inner cable 4; a small-diameter cylindrical section 13*a* which protrudes from one end of the connection section 3 and has a smaller diameter than the connection section 3; and a stopper flange section 13*b* which has a disk shape having a larger diameter than the small-diameter cylindrical section 13*a* and a smaller diameter than the connection section 3. This connection fitting 13 is connected to a restriction wall 10 of the connection aid 9 described below.

There are two restriction walls 10 disposed along the outer cables 5 fixed to the fitting fixing recesses 9*a*. In each restriction wall 10, a guide hole 11 is bored which the small-diameter cylindrical section 13*a* of the connection fitting 13 can pass through and which has a width smaller than the diameter of the stopper flange section 13*b*. One of the guide holes 11 is formed by an arched hole with a curvature equal to that of the trajectory of movement of a cable connection hole 6 in the operation handle 2-1, while the other is formed by an arched hole with a curvature equal to that of the trajectory of movement of a cable connection hole 6 in the lock knob 2-2. As shown in parts (b) and (c) of FIG. 3, the inner cable 4 is mounted on the restriction wall 10 by passing the stopper flange section 13*b* through an introduction hole 11*a* which is formed at the rear end of the guide hole 11. In the mounted state, the connection fitting 13 is capable of moving in such a manner as to be guided by the guide hole 11. Then, when the connection fitting 13 is moved from the mounted position, the stopper flange section 13*b* and the connection section 3 sandwich the restriction wall 10 therebetween and therefore prevent the connection fitting 13 from being removed from the guide hole 11.

The connection aid 9 configured as above is connected to the handle base 1 by sliding the bottom face of the connection aid 9 on a slide guide face 1*a* formed on the handle base 1. As shown in FIG. 4, the slide guide face 1*a* is formed by a flat face that is parallel with the center axis of the cable connection hole 6 of each operating section 2. In a state where the bottom face of the connection aid 9 is placed on the slide guide face, the center line of the cable connection hole 6 of each operating section 2 and the center line of the connection fitting of the corresponding inner cable 4 inside the connection aid 9 are disposed on the same plane.

Moreover, the handle base 1 is provided with a positioning protrusion 1*b* and a locking claw 1*c*. As the connection aid 9 is slid with a positioning hole 9*b* fitted on the positioning protrusion 1*b*, the locking claw 1*c* is snap-locked onto an edge of a locking hole 9*c*. Once the locking claw 1*c* is snap-locked, removal of the connection aid 9 is restricted.

The operation handle 2-1 of the handle device is held at its initial rotational position by a spring not shown, and the lock knob 2-2 of the handle device is held at its initial rotational position by the sliding resistance exerted upon operation. For this reason, the cable connection hole 6 of each operating section 2 is held at a predetermined position. On the other hand, with one end of each cable device 8 connected to the door lock device 7, the position of the connection fitting 13 on the guide hole 11 is mostly determined by the state of the door lock device 7.

Thus, when the positioning hole 9*b* of the connection aid 9 is brought into coincidence with the positioning protrusion 1*b* with each operating section 2 held at the predetermined initial position and with the door lock device 7 held at a predetermined position, the center axis of the connection section 3 of each inner cable 4 and the center axis of the cable connection hole 6 of the corresponding operating section 2 coincide with each other, as shown in part (b) of FIG. 4. By sliding the connection aid 9 from this state along the positioning protrusion 1*b*, the connection section 3 is inserted from its free end into the cable connection hole 6 and connected to the operating section 2, as shown in part (c) of FIG. 4. The insertion opening 12, which is bored in the handle base 1, is closed when the mounting operation is finished.

As shown in part (b) of FIG. 4, a tapered portion 3*a* is formed at the free end of each connection section 3 and a guide block portion 2*b* is formed around each cable connection hole 6 so that the connection section 3 can be smoothly inserted into the cable connection hole 6 when the connection aid 9 is slid.

EXPLANATION OF REFERENCE NUMERALS

1 HANDLE BASE
2 OPERATING SECTION
3 CONNECTION SECTION
4 INNER CABLE
5 OUTER CABLE
6 CABLE CONNECTION HOLE
7 DOOR LOCK DEVICE
8 CABLE DEVICE
9 CONNECTION AID
10 RESTRICTION WALL
11 GUIDE HOLE
12 INSERTION OPENING

The invention claimed is:

1. A handle device for a vehicle comprising:

an operating section rotatably connected to a handle base;

a cable device formed by slidably inserting, in an outer cable, an inner cable including a connection section at a front end thereof, and configured such that the connection section of the inner cable is fitted in a cable connection hole bored in the operating section, to thereby transmit operating force applied to the operating section to a door lock device on a vehicle side; and a connection aid connected to a front end of the outer cable and mounted on the handle base while movably holding the connection section of the inner cable; wherein the inner cable is configured such that, when the connection aid is mounted, the connection section is fitted from a free end thereof into the cable connection hole, and movement of the inner cable in a direction in which the connection section is fitted into the cable connection hole is restricted by a restriction wall formed on the connection aid;

the cable connection hole is formed so as to prevent the connection section from being fitted into, or removed from, the cable connection hole through a periphery of the cable connection hole;

an end of the connection section of the inner cable opposite the end thereof fitted in the cable connection hole is guided by a guide hole formed in the restriction wall to move within and not to fall from the guide hole; and at least a portion of the connection aid directly contacts the handle base.

2. The handle device for a vehicle according to claim 1, wherein the connection aid is connected to the handle base by being slid along the handle base and snap-locked onto the handle base.

3. The handle device for a vehicle according to claim 1, wherein a plurality of the operation sections are connected to the handle base, a plurality of the cable devices connected respectively to the plurality of operation sections are connected to the single connection aid, and the inner cable of each of the plurality of cable devices is connected to the cable connection hole of the corresponding operating section of the plurality of the operating sections when the connection aid is mounted onto the handle base.

4. The handle device for a vehicle according to claim 1, wherein the connection aid is formed in a cover shape to close an insertion opening which is bored in the handle base for the operating section, and to isolate a surface region of the handle base from a door inner space in cooperation with the handle base.

5. The handle device for a vehicle according to claim 1, wherein the periphery of the cable connection hole is closed.

6. The handle device for a vehicle according to claim 1, wherein the connection aid is directly connected to the front end of the outer cable.

* * * * *